US008941458B2

(12) United States Patent
Hara et al.

(10) Patent No.: US 8,941,458 B2
(45) Date of Patent: Jan. 27, 2015

(54) COIL UNIT, SUBSTRATE UNIT AND POWER SUPPLY DEVICE

(71) Applicant: TDK Corporation, Tokyo (JP)

(72) Inventors: Yasuhiro Hara, Tokyo (JP); Masaki Sato, Tokyo (JP); Torao Misono, Tokyo (JP); Wataru Nakahori, Tokyo (JP); Haruhiko Sanae, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/866,571

(22) Filed: Apr. 19, 2013

(65) Prior Publication Data

US 2013/0278373 A1 Oct. 24, 2013

(30) Foreign Application Priority Data

Apr. 23, 2012 (JP) ..... 2012-097992

(51) Int. Cl.
*H01F 5/00* (2006.01)

(52) U.S. Cl.
USPC ..... 336/200

(58) Field of Classification Search
USPC ..... 336/65, 83, 200, 232, 192
See application file for complete search history.

(56) References Cited

U.S. PATENT DOCUMENTS 6,211,767 B1 * 4/2001 Jitaru ..... 336/200
6,583,703 B2 * 6/2003 Li ..... 336/192

FOREIGN PATENT DOCUMENTS

JP A-7-99123 4/1995

* cited by examiner

*Primary Examiner* — Tuyen Nguyen
(74) *Attorney, Agent, or Firm* — Oliff PLC

(57) ABSTRACT

In the coil unit 1A of the power supply device 1, the U-shaped plate 51C constituting the U-shaped terminal 50 is used to electrically connect the print-coil substrates 30, 40. Further, the print-coil substrates 30, 40 constituting the coil unit 1A can be connected to the main circuit substrate 20 also by using the U-shaped terminal 50. Here, the print-coil substrate 30 is connected to the print-coil substrate 40 by using the U-shaped terminal 50, by which soldering for fixing the U-shaped terminal 50 is performed from the lower face side of the print-coil substrate 30. Therefore, as compared with a conventional constitution where soldering is performed from both sides of the stacked print-coil substrates, the print coils can be connected by soldering only from one side face, thus making it possible to reduce the amount of work necessary for connecting the print coils.

14 Claims, 13 Drawing Sheets

(a)

(b)

COIL UNIT, SUBSTRATE UNIT AND POWER SUPPLY DEVICE

BACKGROUND OF THE INVENTION

1. Field of the Invention

The present invention relates to a coil unit which is composed of stacked print coils, a substrate unit in which the coil unit is mounted on a main circuit substrate and a power supply device which is constituted so as to include the substrate unit.

2. Related Background Art

The power supply device is constituted with a semiconductor which serves as a switching element, coils such as a transformer and an inductor in which a ferrite core is used, a main circuit substrate which is electrically and mechanically connected to these electronic components, a control substrate which controls the electronic components, and the like.

Of these electronic components, in a coil component obtained by winding a coil around the core, an increase in capacity requires the coil width to be thick so as to withstand a high current or large current. Further, in order to increase step-up or step-down ratio between primary and secondary side, it is necessary to increase the number of coil windings. Therefore, in an attempt to prepare a coil component large in capacity or step-up or step-down ratio, the coil component is made larger in size, which poses a problem. For coping with the above problem, a print coil stack which is obtained by stacking flat coils, each having an insulating substrate on which a conductor pattern is printed, is used to downsize the coil component (refer to Patent Literature 1, for example).

CITATION LIST

Patent Literature

Patent Literature 1: Japanese Patent Application Laid-Open No. Hei-7-99123

SUMMARY OF THE INVENTION

Technical Problem

In the print coil of Patent Literature 1, after the flat coils are stacked, a connection terminal made of rod material is soldered to connect conductors of the thus stacked flat coils. However, in an attempt to solder the terminal made of rod material as described in the print coil of Patent Literature 1, it is necessary to solder both sides of the stacked flat coil. Therefore, assembly work including soldering is made complicated, which has posed a problem.

The present invention has been made in view of the above problem, an object of which is to provide a coil unit in which stacked print coils can be easily connected, a substrate unit in which the coil unit is mounted on a main circuit substrate, and a power supply device which is constituted so as to include the substrate unit.

Solution to Problem

In order to attain the above object, the coil unit of the present invention is constituted with a primary print-coil substrate in which a conductor pattern is formed inside a flat substrate, a secondary print-coil substrate which is stacked above the primary print-coil substrate and in which a conductor pattern is formed inside a flat substrate, and a U-shaped terminal which is comprised a U-shaped conductor and electrically connects the conductor pattern of the primary print-coil substrate with the conductor pattern of the secondary print-coil substrate. The primary print-coil substrate is provided with a first connection terminal part which is formed so as to have a through hole electrically connected to the conductor pattern, the secondary print-coil substrate is provided with a second connection terminal part which is formed so as to have a through hole electrically connected to the conductor pattern, and two open ends of the U-shaped terminal are respectively inserted through the first connection terminal part and the second connection terminal part from above the secondary print-coil substrate.

In the above-described coil unit, the primary print-coil substrate is electrically connected to the secondary print-coil substrate by the U-shaped terminal inserted from the upper face side of the secondary print-coil substrate. Here, in the coil unit, since these print-coil substrates are connected by using the U-shaped terminal, the terminal can be fixed by soldering from the lower face side of the primary print-coil substrate. Therefore, the print coils are connected by soldering only from one side face, thereby reducing the amount of work necessary for connecting the print coils.

Here, the coil unit is available in such a mode that is further provided with a first external-use U-shaped terminal and a second external-use U-shaped terminal which are the same in shape with the above-described U-shaped terminal. And, in this coil unit, the primary print-coil substrate is provided with a first external-use terminal part which is formed so as to have a through hole electrically connected to the conductor pattern at a position different from the side connecting to the first connection terminal part of the conductor pattern, the secondary print-coil substrate is provided with a second external-use terminal part which is formed so as to have a through hole electrically connected to the conductor pattern at a position different from the side connecting to the second connection terminal part of the conductor pattern, one of two open ends of the first external-use U-shaped to is inserted through the first external-use terminal part from the upper face side of the secondary print-coil substrate, and one of two open ends of the second external-use U-shaped terminal is inserted through the second external-use terminal part from above the secondary print-coil substrate.

According to the above-described constitution, there are provided such terminals that the first external-use U-shaped terminal and the second external-use U-shaped terminal the same in shape with the U-shaped terminal are used to connect externally. Therefore, it is possible to form terminals for connecting with the print coils and connecting with an external circuit at the same time. Further, the first external-use U-shaped terminal and the second external-use U-shaped terminal are the same in shape with the U-shaped terminal used in connecting the print coils. It is, thereby, possible to eliminate a necessity for newly preparing a component different in shape and also reduce the amount of work.

The coil unit is also available in such a mode that the U-shaped terminal is further provided with a resin part having a contact face which covers a part of the conductor on the side opposite to the open end side and which is in contact with the secondary print-coil substrate when the two open ends are inserted through the first connection terminal part and the second connection terminal part.

As described above, since the coil unit is provided with the resin part which is in contact with the secondary print-coil substrate, it is possible to fix more reliably the primary print-coil substrate, the secondary print-coil substrate and the U-shaped terminal when the U-shaped terminal is mounted.

Further, the coil unit is also available in such a mode that the resin part is molded in an integrated manner so as to cover at least one of the conductors of the first external-use U-shaped terminal and the second external-use U-shaped terminal.

As described above, the U-shaped terminal is molded integrally with at least one of the first external-use U-shaped terminal and the second external-use U-shaped terminal, thus making it possible to reduce the number of components.

Still further, the coil unit is also available in such a mode that the resin part has a recessed part formed around the conductor on the contact face which is in contact with the secondary print-coil substrate.

As described above, the recessed part is formed around the conductor. Thus, on fixing the U-shaped terminal by soldering, influences of the resin part on a soldering shape can be avoided to conduct soldering more favorably.

The substrate unit of the present invention is available in such a mode that is provided with the above-described coil unit and a main circuit substrate which is installed on the lower face side of the primary print-coil substrate of the coil unit, in which an open end on the side which is not inserted through the first external-use terminal part in the first external-use U-shaped terminal and an open end on the side which is not inserted through the second external-use terminal part in the second external-use U-shaped terminal are inserted through connection through-holes installed on the main circuit substrate and electrically connected to the conductor pattern installed on the main circuit substrate, thereby being connected to the conductor pattern installed on the main circuit substrate.

Here, the substrate unit may be available in such a mode that the open end length of the U-shaped terminal, that of the first external-use U-shaped terminal and that of the second external-use U-shaped terminal is longer than a total sum comprising the thickness of the primary print-coil substrate, the thickness of the secondary print-coil substrate and the thickness of the main circuit substrate, the main circuit substrate is further provided with a cut-off port through which each of the open ends not being inserted through the connection through-hole is inserted, among the open ends of the U-shaped terminal, the first external-use U-shaped terminal and the second external-use U-shaped terminal, and a side face of the open end is kept away from an inner face of the cut-off port when the open end is inserted.

As described above, each open end is made equal in length and also the main circuit substrate is provided with the cut-off port, thereby eliminating a necessity for adjusting the open end length of the U-shaped terminal depending on whether being in contact with the main circuit substrate or not. It is, thus, possible to mount the U-shaped terminal on the substrate unit.

Further, the power supply device of the present invention is provided with the substrate unit and a casing which houses the substrate unit, in which the lower face side of the substrate unit is mounted so as to be in contact with a bottom face of the casing.

As described above, the lower face side of the substrate unit is mounted so as to be in contact with the bottom face of the casing, thus making it possible to release favorably heat generated in the substrate unit to the easing side.

Here, the power supply device may be available in such a mode that the substrate unit is pressed by a pressing member against the bottom face of the casing along a direction at which the primary print-coil substrate, the secondary print-coil substrate and the main circuit substrate are stacked.

As described above, the substrate unit is pressed by the pressing member, by which the substrate unit is brought into contact with the casing more reliably to further increase the heat radiating effect.

Advantageous Effects of Invention

The present invention is to provide a coil unit in which stacked print coils can be connected easily, a substrate unit in which the coil unit is mounted on a main circuit substrate and a power supply device which is constituted so as to include the substrate unit.

DESCRIPTION OF THE PREFERRED EMBODIMENTS

Hereinafter, a detailed description will be given of an embodiment for executing the present invention with reference to the attached drawings. In describing the drawings, the same reference signs will be given to the same constituents, with overlapping description omitted here.

Figure 1:
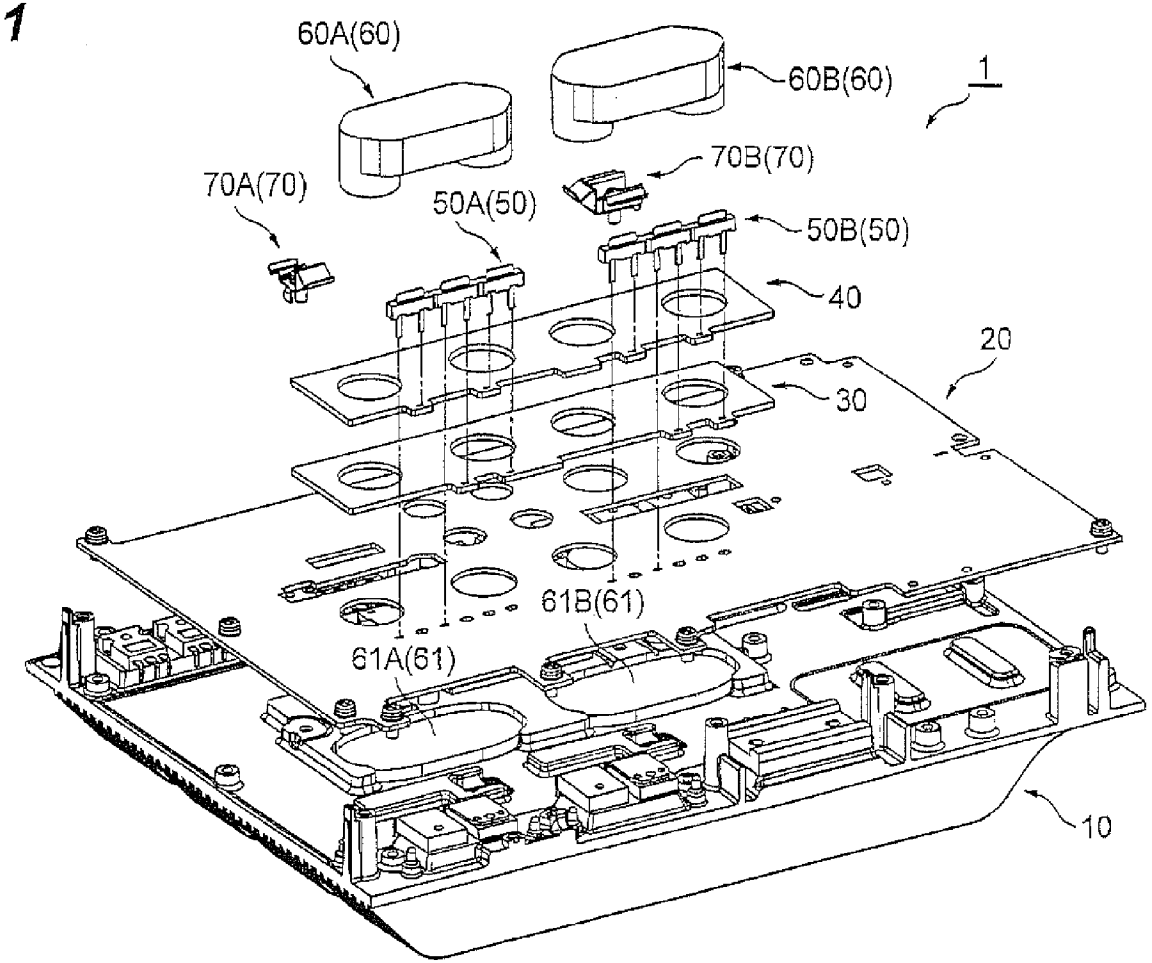
FIG. 1 is an exploded perspective view which shows a general constitution of a power supply device of the present embodiment.

FIG. 1 is an exploded perspective view which describes a general constitution of the power supply device of the present embodiment. The power supply device 1 of the present embodiment is constituted so as to include a casing 10, a main circuit substrate 20, a print-coil substrate 30 (primary print-coil substrate), a print-coil substrate 40 (secondary print-coil substrate), U-shaped terminals 50 (50A, 50B), ferrite cores 60 (60A, 60B), 61 (61A, 61B), and spring supports 70 (70A, 70B). The power supply device 1 is constituted in such a manner that individual components constituting the power supply device including the main circuit substrate 20 on which a control circuit and the like are placed are housed in a case. More specifically, there are housed an input capacitor, a switching element, a main transformer, a chalk inductor, an output capacitor and the like. These components function as a DC-DC converter, for example, by being connected by a pattern of the main circuit substrate 20 and a conductive member such as a bus bar.

The casing 10 constitutes a part of the metal case of the power supply device 1. In the power supply device 1, after the above-described electric components are housed inside the casing 10, they are covered with a cover. A heat radiating fin for cooling the casing 10 is installed on a bottom face side of the casing 10, and the heat radiating fin is air-cooled. Thereby, the casing 10 is cooled and the individual components of the power supply device 1 placed on the upper face side are then cooled. That is, the casing 10 functions as a heat sink which radiates heat from the electronic components constituting the power supply device 1.

In the power supply device 1, the two print-coil substrates 30, 40 stacked in the thickness direction of the main circuit substrate 20 are fixed by the U-shaped terminals 50 and they are held between the ferrite cores 60, 61, thereby constituting an inductor. Further, the main circuit substrate 20 and the print-coil substrates 30, 40 are fixed to the casing 10 side by using the spring supports 70. Hereinafter, a detailed description will be given of the above constitution.

Figure 2:
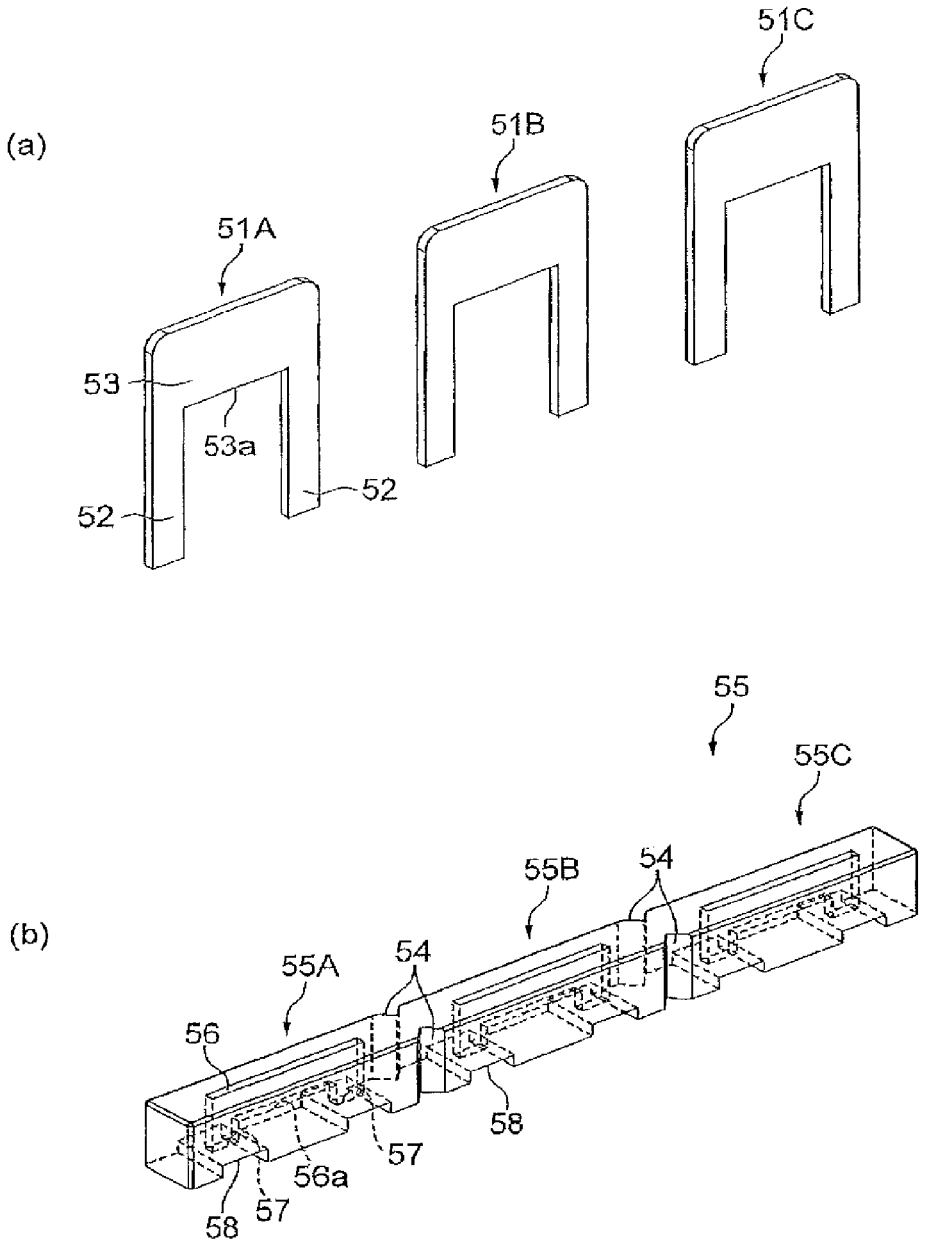
FIG. 2 (*a*) is a schematic perspective view which describes a U-shaped plate which constitutes a U-shaped terminal, and FIG. 2 (*b*) is a schematic perspective view which describes a resin part which constitutes the U-shaped terminal.
Figure 3:
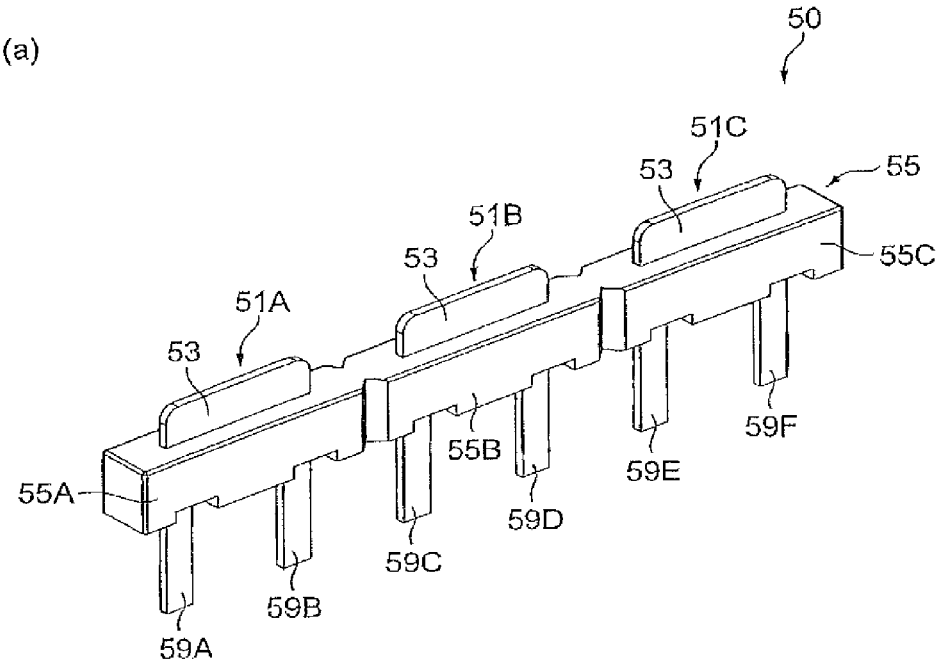
FIG. 3 (*a*) is a schematic perspective view which describes a constitution of the U-shaped terminal in combination with the U-shaped plate with the resin part, and FIG. 3 (*b*) is a front view of the U-shaped terminal.
Figure 3:
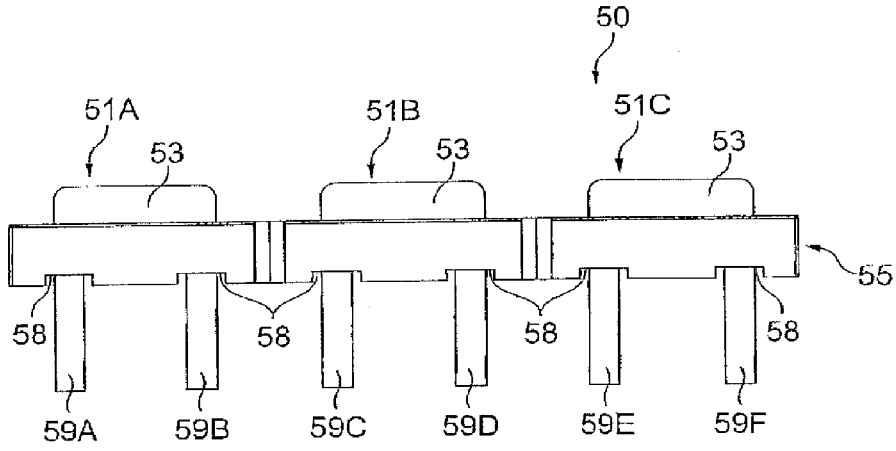

FIG. 2 (*a*) is a schematic perspective view which describes U-shaped plates 51A to C constituting the U-shaped terminal 50. FIG. 2(*b*) is a schematic perspective view which describes a resin part 55 constituting the U-shaped terminal 50. Further, FIG. 3(*a*) is a schematic perspective view which describes a constitution of the U-shaped terminal 50 in combination with the U-shaped plate 51 with the resin part 55. FIG. 3(*b*) is a front view which shows the U-shaped terminal 50.

The U-shaped terminal 50 is constituted by combining three sheets of the U-shaped plates 51 (51A to C) with the resin part 55. Each of these U-shaped plates 51A to C is formed by punching a metal flat plate into the shape of the letter U and constituted with two open ends 52, each of which gives an approximately rectangular terminal part arranged parallel, and a connection part 53 which connects one end of the open end 52 with one end of the open end 52. Each of the two open ends 52 of the U-shaped plate is equal in length and formed so as to give a flat rectangular cross section. As shown in FIG. 3 (*a*), in the U-shaped terminal 50, the three U-shaped plates 51A to C are mounted respectively on the resin parts 55 to be described later, with the connection parts 53 placed upward on the same plane.

In the resin part 55 of the U-shaped terminal 50, an approximately rectangular parallelepiped shaped resin part 55A on which the U-shaped plate 51A is fixed, an approximately rectangular parallelepiped shaped resin part 55B on which the U-shaped plate 51B is fixed and an approximately rectangular parallelepiped shaped resin part 55C on which the U-shaped plate 51C is fixed are formed in such a manner that each end thereof in a longitudinal direction is connected with each other. And, the resin parts 55A, 55B, 55C, each of which is the same in shape, are connected serially in this order. A description will be given of a constitution thereof with reference to the resin part 55A. A through hole 56 which is formed into the shape of the letter U which is reversed when viewed from the front is provided on the approximately rectangular parallelepiped shaped resin part 55A so as to penetrate from the upper face to the lower face of the resin part 55A. The through hole 56 is singular and formed in an approximately rectangular shape at the end on the upper face side but branched nearly at the center, thereby giving two open ports at the end on the lower face side.

A branching face 56*a* installed inside the through hole 56 and parallel with the upper face of the resin part 55A is formed on the U-shaped plate 51A in such a manner that a lower face 53*a* formed between the two open ends 52 is in contact at the connection part 53. And, two hole parts 57 formed further below from the branching face 56*a* at the through hole 56 are formed so that the two open ends 52 of the U-shaped plate 51A penetrate through. And, a recessed part 58, the end face of which is positioned above the entire lower face when viewed from the front, is formed, respectively around an end of the lower face side of each hole part 57 on the lower face of the resin part 55A. Still further, grooves 54 are formed on the front face side and the back face side between the resin parts 55A and 55B and also between the resin parts 55B and 55C. These grooves 54 are formed, by which after the U-shaped plates 51A to 51C are molded integrally, they are separated along the grooves 54, thus making it possible to form a U-shaped terminal which is composed of, for example, the U-shaped plate 51A and the resin part 55A.

The U-shaped terminal 50 is formed by combining the U-shaped plates 51A to C with the resin parts 55A to C. As shown in FIG. 3 (A), (B), the U-shaped plates 51A to C are inserted through the through holes 56 formed respectively at the resin parts 55A to C a state that the connection part 53 is positioned above. Then, the lower face 53*a* of the connection part 53 at each of the U-shaped plates 51A to C is fixed at a position in contact with a branching part 56*a* inside the through hole 56 at each of the resin parts 55A to C. Thereby, the upper side of the connection part 53 of each of the U-shaped plates 51A to C is exposed from the upper face of each of the resin parts 55A to C. And, two terminal parts of each of the U-shaped plates 51A to C also project downward from the recessed part 58 on the lower face of each of the resin parts 55A to C, thereby providing such a constitution that forms terminals 59A to 59F at the open end sides of the U-shaped terminal. That is, the recessed parts 58 are formed respectively around the terminal parts 59A to 59F which project downward from the lower face.

It is noted that the U-shaped terminal 50 may be formed in such a manner that the resin part 55 in which the resin parts 55A to C are integrally molded is subjected to mold forming and the U-shaped plates 51A to C are inserted through the resin part 55 and mounted accordingly. Alternatively, the U-shaped terminal 50 may be formed in such a manner that resin is filled into a mold in which the U-shaped plates 51A to C are arranged side by side to conduct insert, mold forming.

Next, a description will be given of the main circuit substrate 20 and the print-coil substrates 30, 40 which are fixed by the U-shaped terminal 50.

As shown in FIG. 1, in the power supply device 1 of the present embodiment, two transformers are formed with the main circuit substrate 20, the print-coil substrates 30, 40, the U-shaped terminals 50A, 50B, as well as U-type cores 60A, 60B and I-type cores 61A, 61B which are composed of two ferrites.

Figure 4:
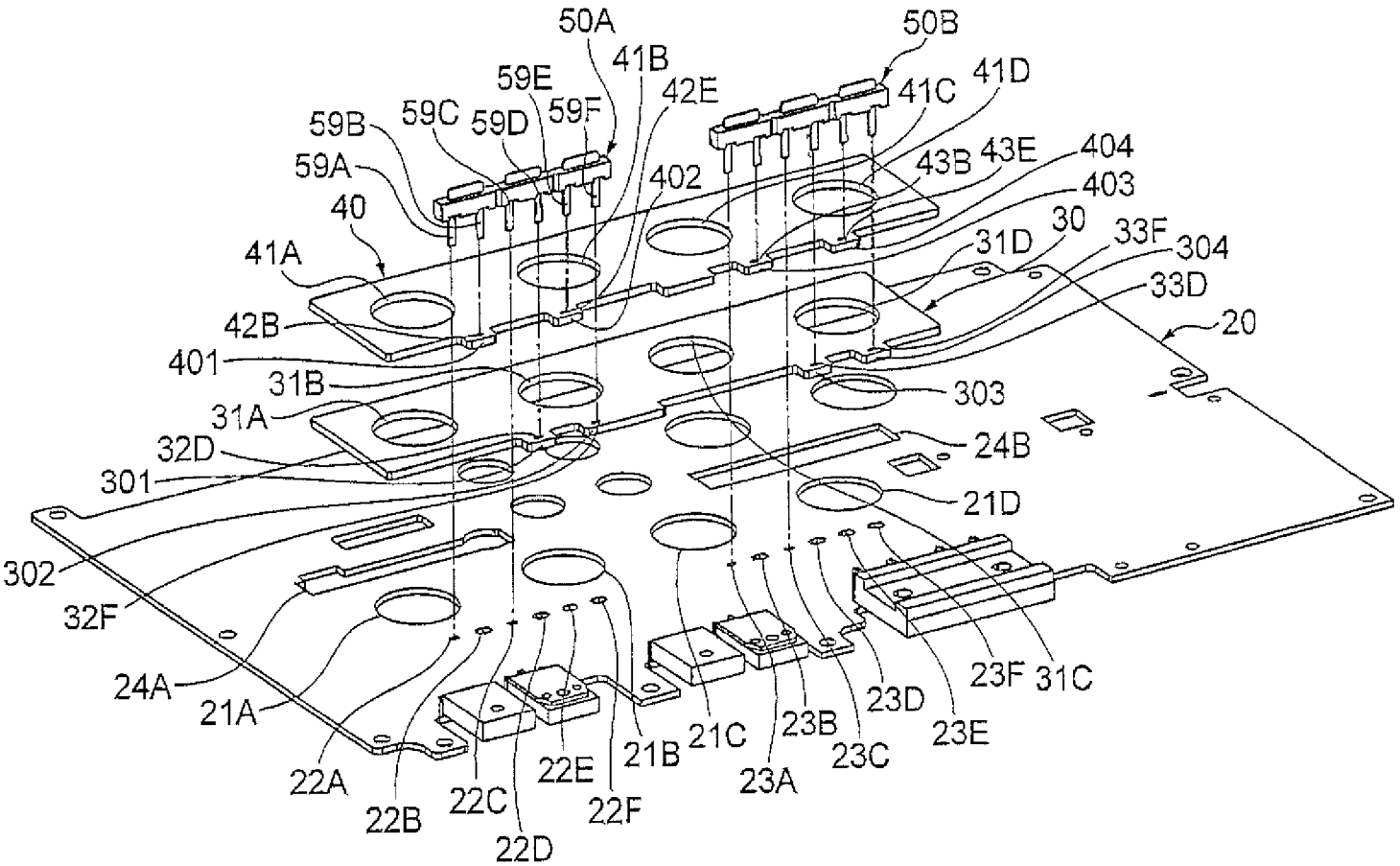
FIG. 4 is a schematic exploded perspective view which describes constitutions of a main circuit substrate 20, print-coil substrates 30, 40 and U-shaped terminals 50A, 50B.
Figure 5:
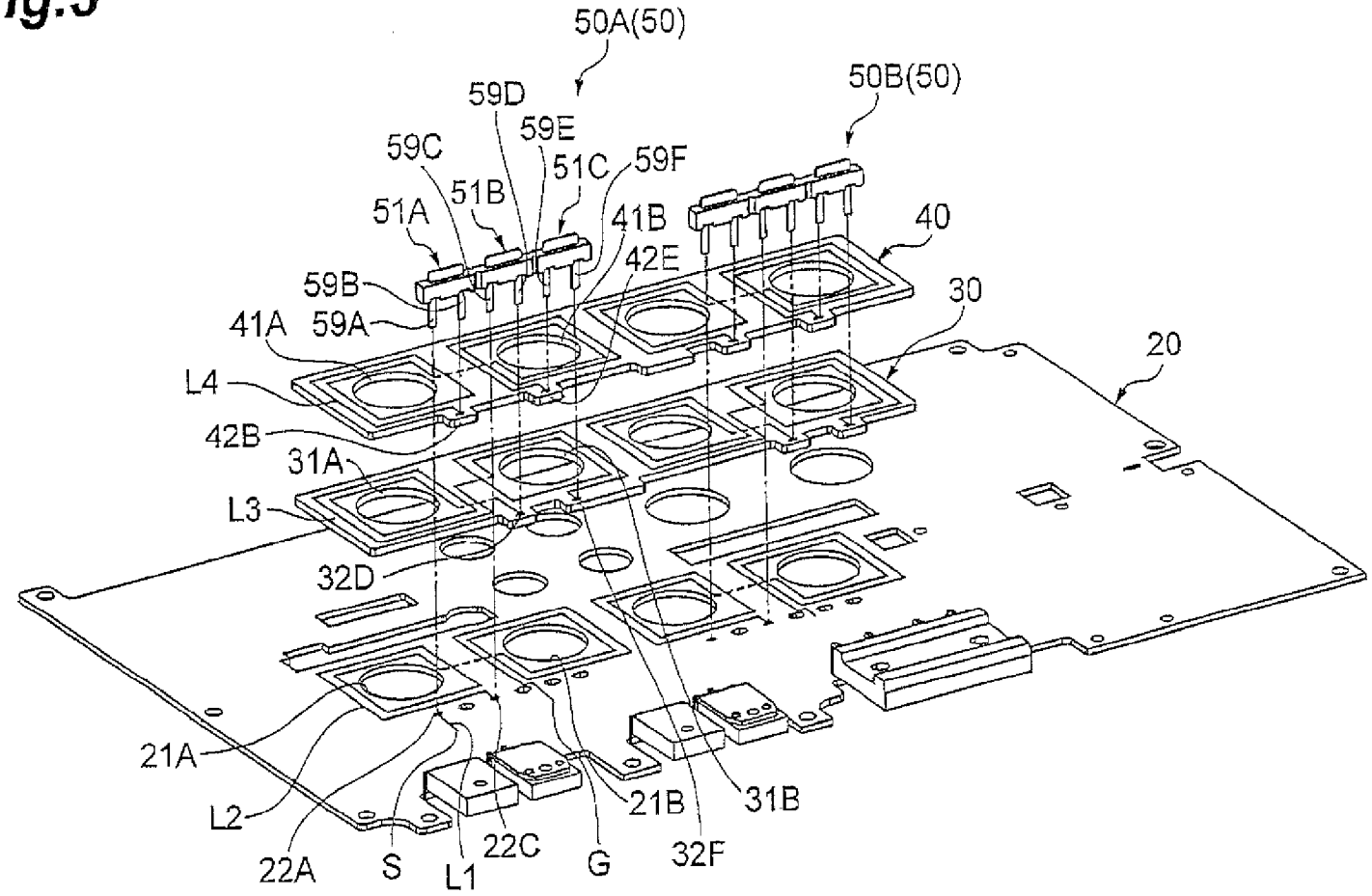
FIG. 5 is a view which describes circuit constitutions of the main circuit substrate 20, the print-coil substrates 30, 40 and the U-shaped terminals 50A, 50B and also a drawing in which circuit patterns are added to FIG. 4.

FIG. 4 is a schematic exploded perspective view which describes constitutions of the main circuit substrate 20, the print-coil substrates 30, 40, and the U-shaped terminals 50A, 50B. Further, FIG. 5 is a drawing which describes circuit constitutions of the main circuit substrate 20, the print-coil substrates 30, 40 and the U-shaped terminals 50A, 50B and also a drawing in which circuit patterns are added to FIG. 4.

The main circuit substrate 20 is formed in such a manner that a circuit pattern composed of conductors is formed on the front and back sides of a base plate made with an insulating material and the circuit pattern is covered with an insulating material such as resin. The conductors of the circuit pattern are connected to electronic components such as a semiconductor element connected to the main circuit substrate 20, thereby constituting a power circuit of the power supply device 1.

The main circuit substrate 20 of the present embodiment is provided with two through holes 21A, 21B for inserting through leg parts of the U-type core 60A and two through holes 21C, 21D for inserting through leg parts of the U-type core 60B. A circuit pattern is formed around these through holes 21A to 21D and the circuit pattern will be specifically described later.

Six through holes 22A to 22F are installed on the main circuit substrate 20 so as to run along an array of the two through holes 21A, 21B. Six through holes 23A to 23F are installed in a similar manner so as to run along an array of the two through holes 21C, 21D. Further, opening holes 24A, 24B for mounting spring supports 70 are installed on the side opposite to the through holes 23A to 23F so as to run along an array of the through holes 21A to D.

An interval between each of the six through holes 22A to 22F on the main circuit substrate 20 corresponds to an interval between each of the terminals 59A to 59F of the U-shaped terminal 50A. That is, there is provided such a constitution that the terminals 59A to 59F can be inserted through the through holes 22A to 22F. Among these six through holes, the through holes 22A, 22C are formed with such an inner diameter that on inserting the terminals 59A, 59C of the U-shaped terminal 50A, inner faces of the through holes 22A, 22C are in contact with the surfaces of the terminals 59A, 59C. Then, an end of each of the conductors which form the circuit pattern inside the main circuit substrate 20 is exposed on the inner faces of the through holes 22A, 22C, by which, when the U-shaped terminal 50A is mounted, the conductor inside the through hole 22A can be connected to the terminal 59A and the conductor inside the through hole 22C can be connected to the terminal 59C. On the other hand, the through holes 22B, 22D to 22F are made greater in inner diameter than the terminals 59B, 59D to 59F of the U-shaped terminal 50A.

The print-coil substrate 30 placed on the main circuit substrate 20 is an approximately rectangular flat plate shape and formed by forming a circuit pattern composed of conductors on the front and back sides of a base plate made with an insulating material and also covering the circuit pattern with an insulating material such as resin. Further, the print-coil substrate 30 is provided with two through holes 31A, 31B for inserting through leg parts of the U-type core 60A and two through holes 31C, 31D for inserting through leg parts of the U-type core 60B, and the circuit pattern is formed around the through holes 31A to 31D.

The print-coil substrate 30 is provided with raised parts 301 to 304 which project outward from one of the long sides extending in the longitudinal direction of the substrate on which the through holes 31A to 31D are arranged side by side, and the raised parts 301 to 304 are respectively provided with connection terminal parts 32D, 32F, 33D, 33F which are formed from the through holes. These connection terminal parts 32D, 32F, 33D, 33F are installed at positions corresponding to the terminals 59D, 59F of the U-shaped terminal 50A and the terminals 59D, 59F of the U-shaped terminal 50B. That is, such a constitution is provided that the terminals 59D, 59F of the U-shaped terminal 50A and the terminals 59D, 59F of the U-shaped terminal 50B can be inserted respectively into the connection terminal parts 32D, 32F, 33D, 33F.

Further, an end of each of the conductors which form the circuit pattern is exposed on the inner face of the through hole inside each of the connection terminal parts 32D, 32F, 33D, 33F. Therefore, where the U-shaped terminals 50A, 50B are inserted through the connection terminal parts 32D, 32F, 33D, 33F, the terminal 59D of the U-shaped terminal 50A is connected to the conductor inside the connection terminal part 32D, and the terminal 59F of the U-shaped terminal 50A is connected to the conductor inside the connection terminal part 32F. In a similar manner, the terminal 59D of the U-shaped terminal 50B is connected to the conductor inside the connection terminal part 33D, and the terminal 59F of the U-shaped terminal 50B is connected to the conductor inside the connection terminal part 33F.

The print-coil substrate 40 is an approximately rectangular flat plate shape which is stacked on the upper face of the print-coil substrate 30 and formed in such a manner that a circuit pattern composed of conductors is formed on the front and back sides of a base plate made with an insulating material and also the circuit pattern is covered with an insulating material such as resin. Further, the print-coil substrate 40 is provided with two through holes 41A, 41B for inserting through leg parts of the U-type core 60A and two through holes 41C, 41D for inserting through leg parts of the U-typo core 60B, and the circuit pattern is formed around the through holes 41A to 41D.

The print-coil substrate 40 is provided with raised parts 401 to 404 which project outward from one of the long sides extending in the longitudinal direction of the substrate on which the through holes 41A to 41D are arranged side by side, and the raised parts 401 to 404 are provided respectively with connection terminal parts 42B, 42E, 43B, 43E which are formed from the through holes. These connection terminal parts 42B, 42E, 43B, 43E are installed at positions corresponding to the terminals 59B, 59E of the U-shaped terminal 50A and the terminals 59B, 59E of the U-shaped terminal 50B. That is, such a constitution is provided that the terminals 59B, 59E of the U-shaped terminal 50A and the terminals 59B, 59E of the U-shaped terminal 50B can be respectively inserted through the connection terminal parts 42B, 42E, 43B, 43E.

Further, an end of each of the conductors which form the circuit pattern is exposed on the inner face of the through hole inside each of the connection terminal parts 42B, 42E, 43B, 43E. Therefore, where the U-shaped terminals 50A, 50B are inserted through the connection terminal parts 42B, 42E, 43B, 43E, the terminal 59B of the U-shaped terminal 50A is connected to the conductor inside the connection terminal part 42B, and the terminal 59E of the U-shaped terminal 50A is connected to the conductor inside the connection terminal part 42E. In a similar manner, the terminal 59B of the U-shaped terminal 50B is connected to the conductor inside the connection terminal part 43B, and the terminal 59E of the U-shaped terminal 50B is connected to the conductor inside the connection terminal part 43E.

As described above, the connection terminal parts 32D, 32F, 33D, 33F, 42B, 42E, 43B, 43E on the print-coil substrate 30 and the print-coil substrate 40 as well as the raised parts 301 to 304, 401 to 404 which form these connection terminal parts are different in position from each other when viewed from above.

Here, a description will be given of the circuit patterns installed inside the main circuit substrate 20 and the print-coil substrates 30, 40 with reference to FIG. 5. It is noted that the power supply device 1 of the present embodiment is provided with two inductors, each of which has a circuit pattern of the same shape. Thus, here, a description will be given of the circuit pattern on a periphery of the inductor side constituted with the U-type core 60A and the I-type core 61A.

First, the main circuit substrate 20 is provided with a pattern L1 which is connected to the through hole 22A from an outside S of the inductor and a pattern L2, an end of which is installed at the through hole 22C and which is rotated 1.5 times around the through hole 21A in a clockwise direction and then rotated 2 times around the through hole 21B in a counter-clockwise direction when viewed from above and thereafter connected to an outside G of the inductor.

Further, the print-coil substrate 30 is formed with a pattern L3, one end of which is installed inside the connection terminal part 32F, and which is rotated 1.5 times around the through hole 31B in a counter-clockwise direction and thereafter rotated two times around the through hole 31A in a clockwise direction and, the other end of which is installed inside the connection terminal part 32D.

Still further, the print-coil substrate 40 is formed with a pattern L4, one end of which is installed inside the connection terminal part 42B, which is rotated 1.5 times around the through hole 41A in a clockwise direction and thereafter rotated 2 times around the through hole 41B in a counter-clockwise direction, and the other end of which is installed inside the connection terminal part 42E.

One circuit is formed with the above-described patterns L1 to L4 given on the main circuit substrate 20 and the print-coil substrates 30, 40 as well as with the U-shaped terminal 50A which connects them. More specifically, an electric current input from the outside S of the inductor passes through the pattern L1 and arrives at the through hole 22A, thereafter, passes from the terminal 59A to the terminal 59B of the U-shaped plate 51A at the U-shaped terminal 50A, and arrives at the connection terminal part 42B through which the terminal 59B is inserted. Then, the electric current flows from the connection terminal part 42B through the pattern L4 inside the print-coil substrate 40 and, thereafter, arrives at the connection terminal part 42E. Subsequently, the electric current passes from the terminal 59E to the terminal 59F of the U-shaped plate 51C at the U-shaped terminal 50A and arrives at the connection terminal part 32F through which the terminal 59F is inserted. Then, the electric current flows from the connection terminal part 32F through the pattern L3 inside the print-coil substrate 30 and, thereafter, arrives at the connection terminal part 32D. Thereafter, the electric current passes through the terminal 59D to the terminal 59C of the U-shaped plate 51B at the U-shaped terminal 50A and arrives at the through hole 22C on the main circuit substrate 20 through which the terminal 59C is inserted. Then, the electric current flows from the through hole 22C through the pattern L2 inside the main circuit substrate 20 and, thereafter, arrives at the outside G of the inductor. Thereby, one circuit which is formed with the above-described patterns L1 to L4 given on the main circuit substrate 20 and the print-coil substrates 30, 40 as well as with the U-shaped terminal 59A which connects them will function as a coil which is rotated 10.5 times in total.

As described above, in the print-coil substrate 30, the connection terminal part 32D will function as a first external connection terminal part which is connected to an external circuit via the U-shaped plate 51B. Further, in the print-coil substrate 40, the connection terminal part 42B will function as a second external connection terminal part which is connected to an external circuit via the U-shaped plate 51A. Still further, the U-shaped plate 53C (terminals 59E, 59F) which connects the connection terminal part 42B functioning as the second connection terminal part with the connection terminal part 32F functioning as the first connection terminal part will function as the U-shaped terminal which connects between the print-coil substrates. The U-shaped plate 51B (terminals 59C, 59D) which connects the through hole 22C with the connection terminal part 32D will function as a first external-use U-shaped terminal, and the U-shaped plate 51A (terminals 59A, 59B) which connects the through hole 22A with the connection terminal part 42B will function as a second external-use U-shaped terminal.

Next, a description will be given of a method for assembling the above-constituted power supply device 1. First, the print-coil substrate 40 is stacked on the print-coil substrate 30, and terminals of the two U-shaped terminals 50A, 50B are inserted through the connection terminal parts 32D, 32F, 33D, 33F, 42B, 42E, 43B, 43E of the print-coil substrate 30. Then, the connection terminal parts 32D, 32F, 33D, 33F, 42B, 42E, 43B, 43E are soldered from the lower face side, by which the U-shaped terminal 50 is fixed to the print-coil substrates 30, 40 to form a coil unit composed of the print-coil substrates 30, 40 and the U-shaped terminal 50. Thereafter, the coil unit is mounted on the main circuit substrate 20, and the U-shaped terminal is fixed to the main circuit substrate by soldering. Thereafter, the main circuit substrate 20 on which the coil unit has been mounted is fixed, while being pressed to the casing 10 by the spring supports 70, and also held between the cores.

Figure 6:
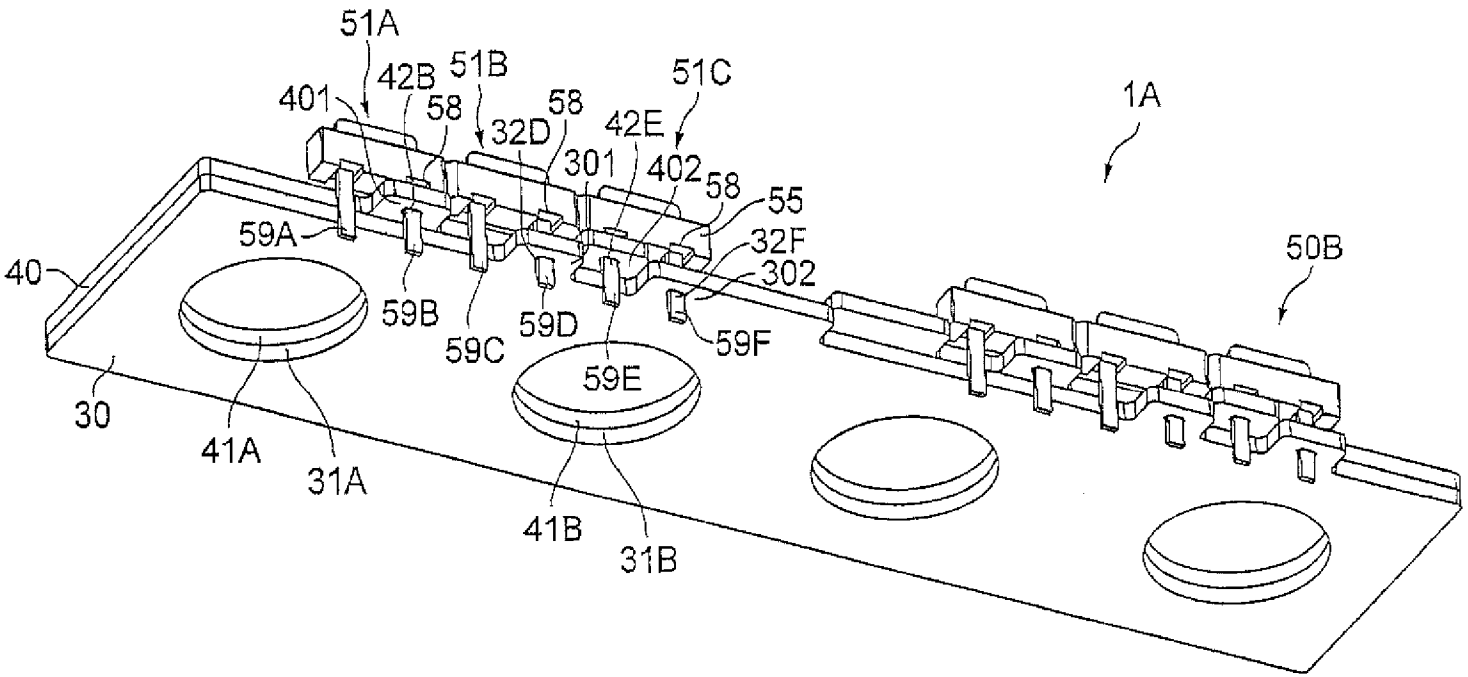
FIG. 6 is a perspective view of a coil unit 1A composed of the print-coil substrates 30, 40 and the U-shaped terminals 50A, 50B, when viewed from the lower face side.

FIG. 6 is a perspective view which is obtained by viewing the coil unit 1A composed of the print-coil substrates 30, 40 and the U-shaped terminals 50A, 50B from the lower face side. As shown in FIG. 6, where the print-coil substrates 30, 40 are stacked, the raised parts 301, 302, 401, 402 which constitute the connection terminal parts 32D, 32F, 42B, 42E are installed at mutually different positions when viewed from above. Then, the U-shaped terminal 50A is mounted on the stacked print-coil substrates 30, 40. At this time, as shown in FIG. 6, the terminal 59B penetrates through the connection terminal part 42B, the terminal 59D penetrates through the connection terminal part 32D, the terminal 59E penetrates through the connection terminal part 42E, and the terminal 59F penetrates through the connection terminal part 32F. Thereafter, these four connection terminal parts 32D, 32F, 42B, 42E are soldered from the lower face side. Here, where the connection terminal part 42B is soldered, the recessed part 58 formed around the terminal 59B on the lower face side of the resin part 55 will function as a soldering pool to form a soldering fillet having a good shape, thus making it possible to prevent poor connection such as soldering cracks.

Figure 7:
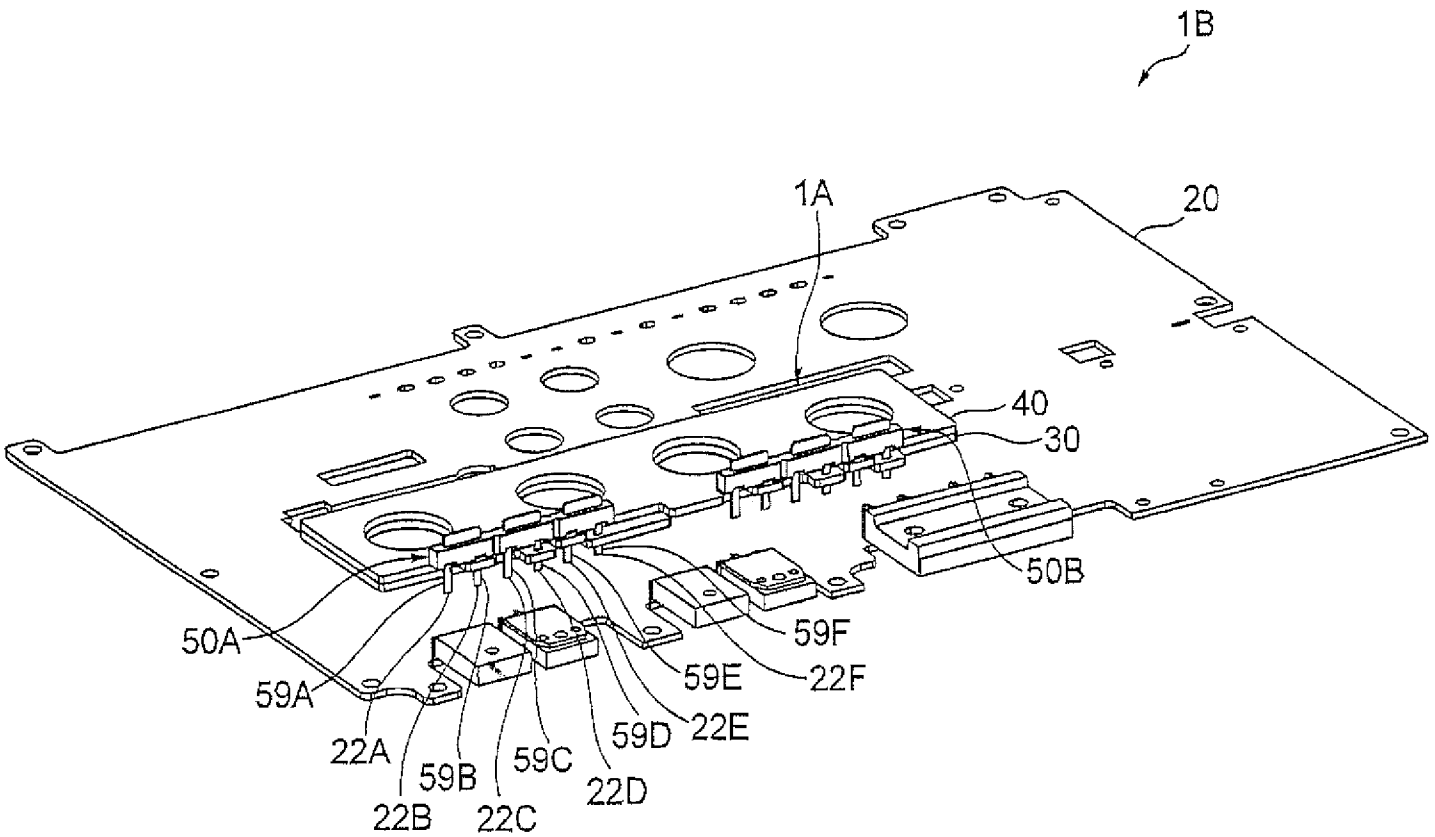
FIG. 7 is a schematic perspective view which shows a substrate unit 1B.
Figure 8:
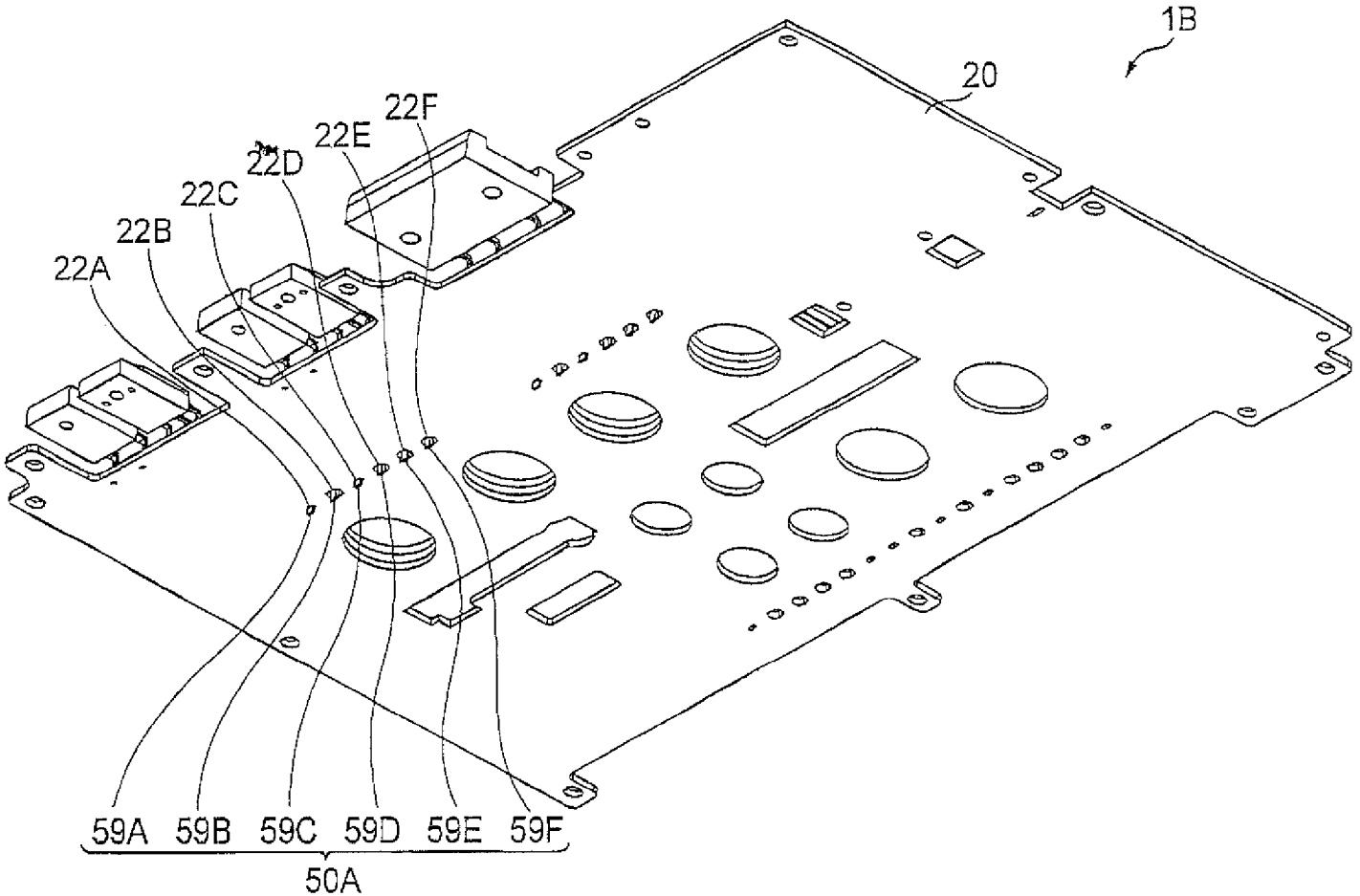
FIG. 8 is a perspective view of the substrate unit 1B in FIG. 7, when viewed from the lower face side.

Next, a description will be given of the substrate unit 1B in which the coil unit 1A is mounted on the main circuit substrate 20 with reference to FIG. 7 and FIG. 8, FIG. 7 is a schematic perspective view which shows the substrate unit 1B, and FIG. 8 is a perspective view of the substrate unit 1B when viewed from the lower face side. As shown in FIG. 7 and FIG. 8, the terminals 59A to 59F are inserted through the through holes 22A to 22F on the main circuit substrate 20. Of these through holes, conductors on the inner faces of the through hole 22A and the through hole 22C are respectively in contact with the terminal 59A and the terminal 59C. On the other hand, the through holes 22B, 22D to 22F are formed so as to be greater in inner diameter than the terminals 59B, 59D to 59F of the U-shaped terminal 50A. Thus, each of the through holes 22B, 22A to 22F will function as a cut-off port. That is, no conductors are exposed on the inner faces of the through holes 22B, 22D to 22F, and the terminals 59B, 59D to 59F are not in contact with the inner faces of the through holes 22B, 22D to 22F. Normally, it is not required that the terminals 59B, 59D to 59F will function to connect with the conductors contained in the main circuit substrate 20. Thus, these terminals can be made shorter in length. However, for the purpose of reducing the number of components, since the conductors, each of which is the same in shape, are used as the U-shaped plates 51A to 51C, a cut-off port is installed on the main circuit substrate 20. Thereafter, the through hole 22A and the through hole 22C are soldered from the lower face side, by which the conductors on the inner faces of the through hole 22A and the through hole 220 are electrically connected to the terminal 59A and the terminal 59C and also the U-shaped terminal 50A is fixed. Thereby, the substrate unit 1B is formed.

In order to increase heat transfer performance between the main circuit substrate 20 and the print-coil substrate 30 as well as between the print-coil substrate 30 and the print-coil substrate 40, a thermal compound obtained by mixing a synthetic grease with a substance high in heat conductivity such as a metal oxide is applied on the surfaces of the main circuit substrate 20 and the print-coil substrates 30, 40. Thereafter, these substrates may be stacked.

Figure 9:
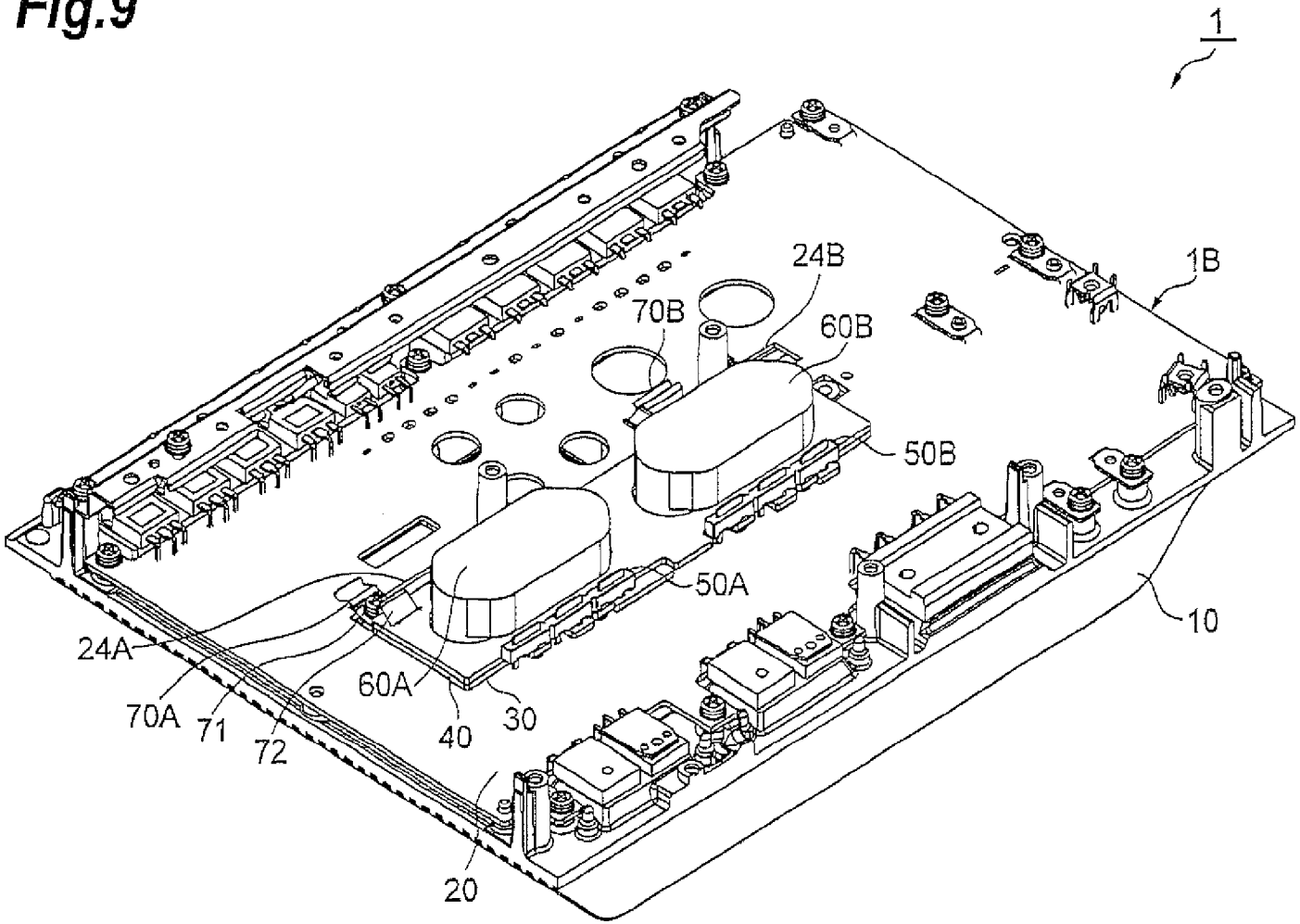
FIG. 9 is a perspective view of a power supply device 1.
Figure 10:
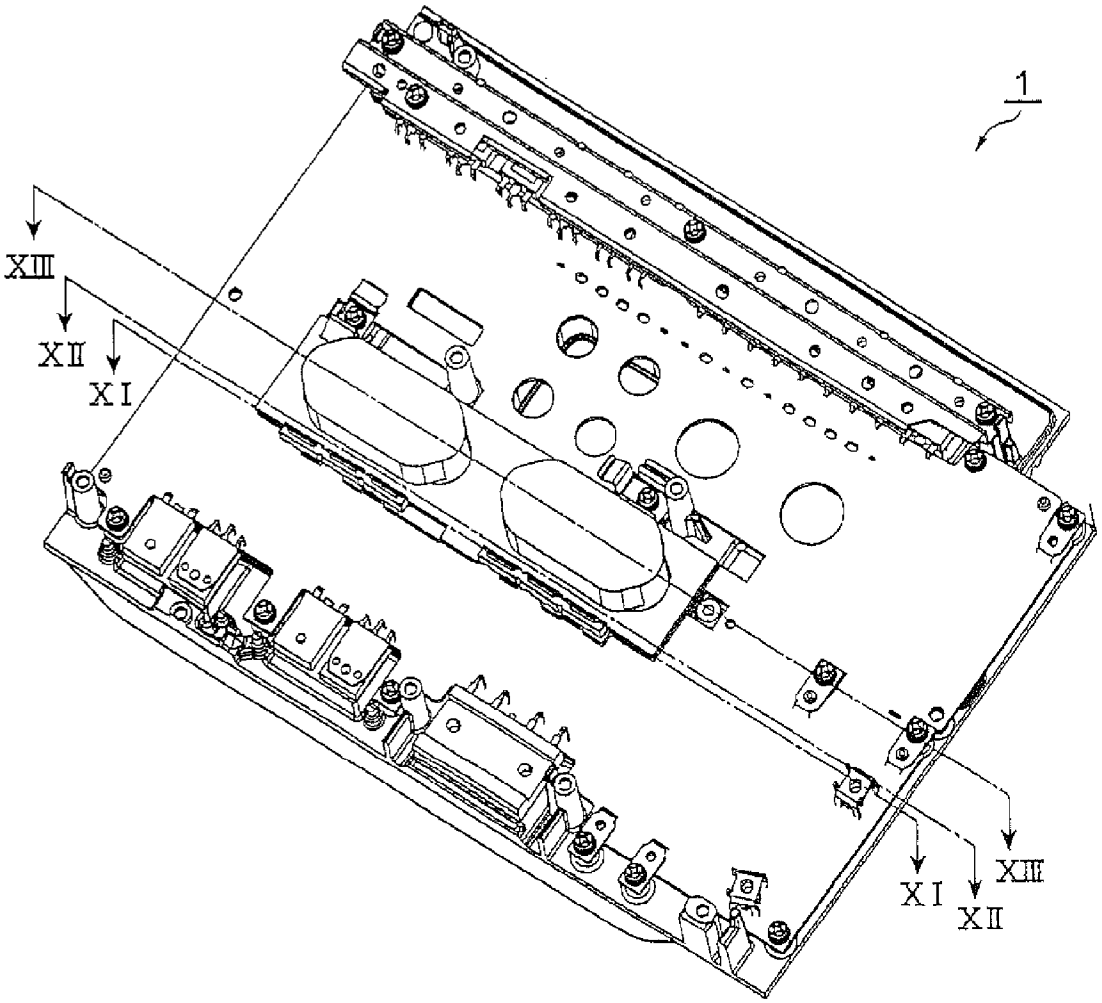
FIG. 10 is a drawing which describes a cut face of a cross sectional view of the power supply device 1.
Figure 11:
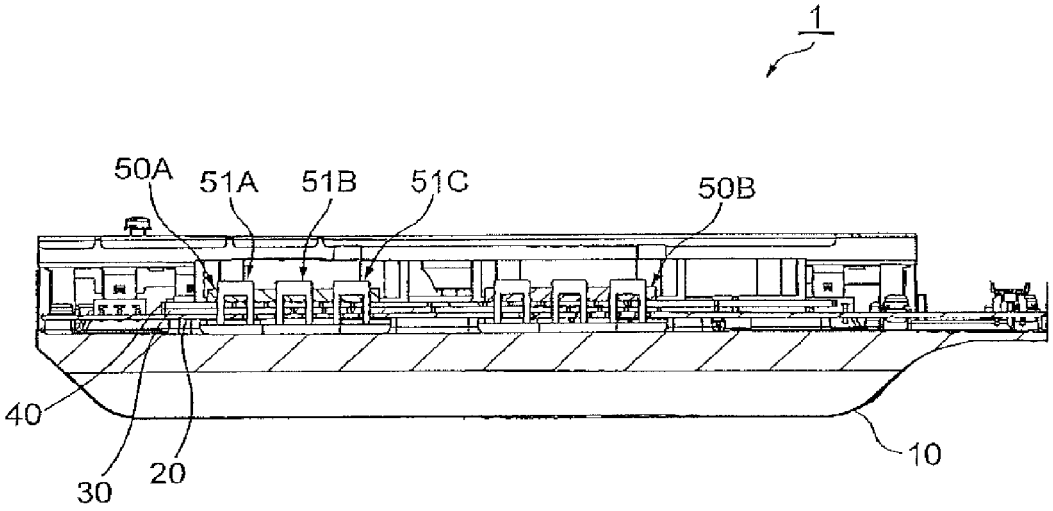
FIG. 11 is a cross sectional view which is taken along the line XI to XI in FIG. 10.
Figure 12:
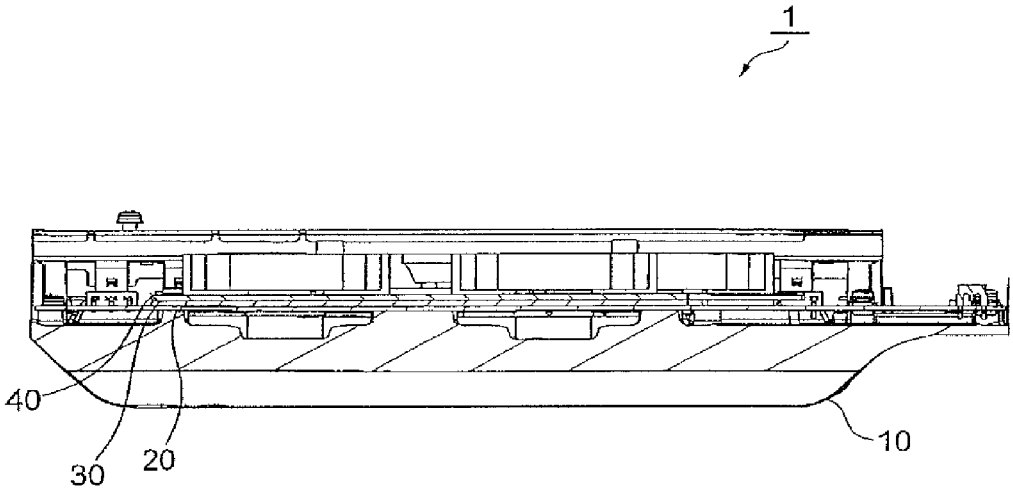
FIG. 12 is a cross sectional view which is taken along the line XII to XII in FIG. 10.
Figure 13:
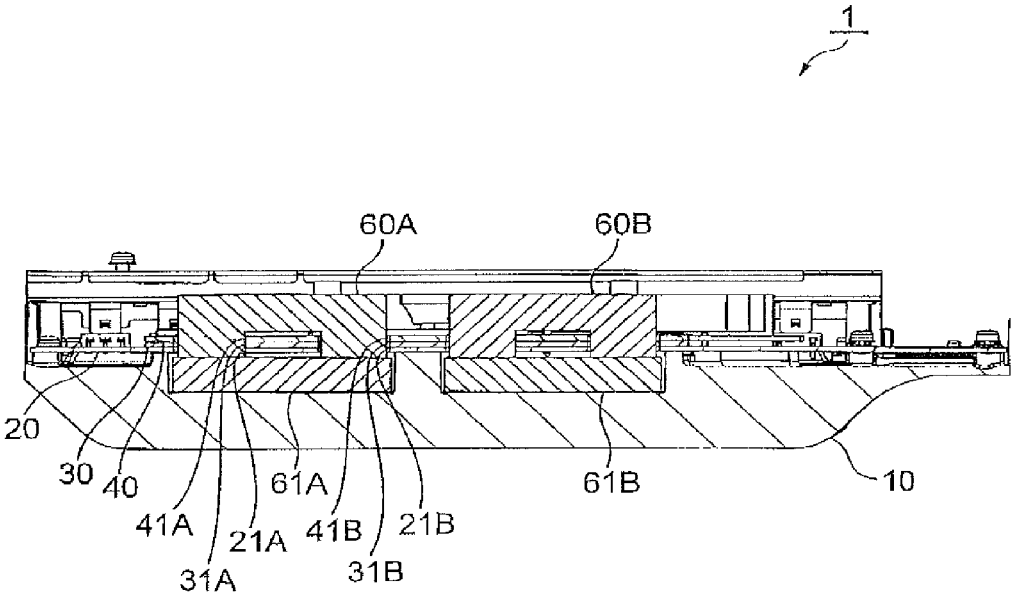
FIG. 13 is a cross sectional view which is taken along the line XIII to XIII in FIG. 10.

Next, the substrate unit 1B is mounted on the casing 10, thereby assembling the power supply device 1. FIG. 9 is a schematic perspective view which describes the thus assembled power supply device 1. Further, FIG. 10 is a drawing which describes a cut face of the power supply device 1. FIG. 11 is a cross sectional view which is taken along the line of XI to XI in FIG. 10. FIG. 12 is a cross sectional view which is taken along the line of XII to XII in FIG. 10. FIG. 13 is a cross sectional view which is taken along the line of XIII to XIII in FIG. 10.

As shown in FIG. 9 to FIG. 13, the two leg parts of the ferrite core 60A are inserted through the through holes 21A, 21B of the main circuit substrate 20, the through holes 31A, 31B of the print-coil substrate 30 and the through holes 41A, 41B of the print-coil substrate 40, thereby holding the substrate unit 1B between the ferrite cores 60, 61 so as to oppose to the ferrite core 61A placed on the bottom face of the casing 10. Further, a supporting part 71 of the spring support 70A is fixed on the bottom face of the casing 10 via the opening hole 24A and the opening hole 24B installed on the main circuit substrate 20, and a leaf spring part 72 installed above the open port 24A is used to press the upper face side of the print-coil substrate 40. Thereby, the substrate unit 1B is pressed as a whole toward the bottom face of the casing 10 and the main circuit substrate 20 is fixed in a state of being in contact with the bottom face of the casing 10.

As described above, in the coil unit 1A of the power supply device 1 according to the present embodiment, the print-coil substrate 30 is electrically connected to the print-coil substrate 40 by the U-shaped terminal 50 in which the three U-shaped plates 51A to 51C are molded integrally. Further, the print-coil substrates 30, 40 which constitute the coil unit 1A are connected to the main circuit substrate 20 also by the U-shaped terminal 50. Here, since they are connected by using the U-shaped terminal 50, soldering for fixing the U-shaped terminal 50 is performed from the lower face side of the print-coil substrate 30. Therefore, as compared with a conventional constitution where soldering is performed from both sides of stacked print-coil substrates, soldering is performed only from one side face to connect print coils, thereby reducing the amount of work for connecting the print coils.

Further, the three U-shaped plates 51A to 51C are formed so as to be the sane in shape. Thus, it is possible to prepare a member for connecting the print-coil substrate 30 with the print-coil substrate 40 and a member for connecting the print-coil substrate 30, 40 with the main circuit substrate 20 without increasing the number and types of components. Therefore, the main circuit substrate 20 can be connected without increasing the number and types of components.

Still further, the U-shaped terminal 50 is provided with the resin part 55, by which when the U-shaped terminal 50 is mounted on the print-coil substrates 30, 40, the resin part 55 is in contact with the print-coil substrate 40 and thereafter can be fixed by soldering. Therefore, connection by the U-shaped terminal 50 can be made more reliably.

Here, a recessed part 58 is formed around each of the terminals 59A to 59F on the lower face side of the resin part 55 (the contact face which is in contact with the print-coil substrate 40). Thereby, soldering can be performed favorably in such a manner that the resin part 55 will not affect the soldering.

Further, in the substrate unit 1B of the power supply device 1 according to the present embodiment, the main circuit substrate 20 is provided not only with the through holes for connecting the print-coil substrates 30, 40 but also with the through holes for functioning as cut-off ports. Thus, there is eliminated a necessity for adjusting the open end length of the U-shaped terminal 50, by which the substrate unit 1B can be assembled more efficiently.

Further, the power supply device 1 of the present embodiment is mounted in such a manner that the lower face side of the substrate unit 1B, that is, the lower face side of the main circuit substrate 20 is in contact with the bottom face of the casing 10. Therefore, it is possible to release favorably heat generated by the substrate unit 1B to the casing 10 side.

Still further, in the power supply device 1 of the present embodiment, a description has been given of the print-coil substrates 30, 40 with reference to the two substrates. However, substrates may be further stacked depending on the number of windings and capacity. In this instance, an interval between each of the terminals 59A to 59F and that between each of the connection terminal parts 32D, 32F, 42B, 42F may be narrowed, or raised parts may be installed according to the number of stacked print-coil substrates.

In addition, the spring support 70 which will function as a pressing member is used to press the substrate unit 1B in a direction at which the substrates are stacked, by which the substrate unit 1B can be in contact with the casing 10 more reliably and heat radiating effects can be further increased. Also, as compared with a case where screws and the like are used to fix the substrate unit 1B, the substrate unit 1B can be fixed by less complicated work.

A description has been so far given of the embodiment of the present invention. The present invention shall not be, however, limited to the above embodiment but can be modified in various ways. In the present embodiment, the U-shaped terminal 50 is described, for example, as a terminal in which three U-shaped plates are molded integrally with resin. However, the terminal may be formed with U-shaped plates which are separated with each other, that is, the terminal may be formed with a single U-shaped plate. Further, although a U-shaped plate obtained by punching out a metal plate is used in the present embodiment, the U-shaped terminal may be prepared, for example, by bending a rod-shaped conductor member into the shape of the letter U.

Further, in the present embodiment, a description has been given of a case where a conductor pattern arranged so as to wind around the periphery of the UI-type ferrite core is connected. It is, however, possible to change the shape of the core and the conductor pattern whenever necessary.

REFERENCE SIGNS LIST

1: Power supply device, 1A: Coil unit, 1B: Substrate unit, 10: Casing, 20: Main circuit substrate, 30, 40: Print-coil substrate, 50: U-shaped terminal, 60, 61: Ferrite cores.

What is claimed is:

1. A coil unit, comprising:

a primary print-coil substrate in which a conductor pattern is formed inside a flat substrate;

a secondary print-coil substrate which is stacked above the primary print-coil substrate and in which a conductor pattern is formed inside a flat substrate; and a U-shaped terminal which is comprised a U-shaped conductor and electrically connects the conductor pattern of the primary print-coil substrate with the conductor pattern of the secondary print-coil substrate; wherein the primary print-coil substrate is provided with a first connection terminal part which is formed so as to have a through hole electrically connected to the conductor pattern, the secondary print-coil substrate is provided with a second connection terminal part which is formed so as to have a through hole electrically connected to the conductor pattern, and two open ends of the U-shaped terminal are respectively inserted through the first connection terminal part and the second connection terminal part from above the secondary print-coil substrate.

2. The coil unit according to claim 1 further comprising:

a first external-use U-shaped terminal and a second external-use U-shaped terminal which are the same in shape with the U-shaped terminal; wherein the primary print-coil substrate is provided with a first external-use terminal part which is formed so as to have a through hole electrically connected to the conductor pattern at a position different from the side connecting to the first connection terminal part of the conductor pattern, the secondary print-coil substrate is provided with a second external-use terminal part which is formed so as to have a through hole electrically connected to the conductor pattern at a position different from the side connecting to the second connection terminal part of the conductor pattern, one of two open ends of the first external-use U-shaped terminal is inserted through the first external-use terminal part from above the secondary print-coil substrate, and one of two open ends of the second external-use U-shaped terminal is inserted through the second external-use terminal part from above the secondary print-coil substrate.

3. The coil unit according to claim 1, wherein the U-shaped terminal is further provided with a resin part having a contact face which covers a part of the conductor on the side opposite to the open end side and which is in contact with the secondary print-coil substrate when the two open ends are inserted through the first connection terminal part and the second connection terminal part.

4. The coil unit according to claim 3, wherein the resin part is molded in an integrated manner so as to cover at least one of the conductors of the first external-use U-shaped terminal and the second external-use U-shaped terminal.

5. The coil unit according to claim 3, wherein the resin part has a recessed part formed around the conductor on the contact face which is in contact with the secondary print-coil substrate.

6. A substrate unit comprising:

the coil unit described in claim 2; and a main circuit substrate which is installed on the lower face side of the primary print-coil substrate of the coil unit; wherein an open end on the side which is not inserted through the first external-use terminal part in the first external-use U-shaped terminal and an open end on the side which is not inserted through the second external-use terminal part in the second external-use U-shaped terminal are inserted through connection through holes installed on the main circuit substrate and electrically connected to the conductor pattern mounted on the main circuit substrate, thereby being connected to the conductor pattern installed on the main circuit substrate.

7. The substrate unit according to claim 6, wherein the open end length of the U-shaped terminal, that of the first external-use U-shaped terminal and that of the second external-use U-shaped terminal is longer than a total sum comprising the thickness of the primary print-coil substrate, the thickness of the secondary print-coil substrate and the thickness of the main circuit substrate, the main circuit substrate is further provided with a cut-off port through which each of the open ends not being inserted through the connection through hole is inserted, among the open ends of the U-shaped terminal, the first external-use U-shaped terminal and the second external-use U-shaped terminal, and a side face of the open end is kept away from an inner face of the cut-off port, when the open end is inserted.

8. A power supply device comprising:

the substrate unit described in claim 6; and a casing which houses the substrate unit; wherein the lower face of the substrate unit is mounted so as to be in contact with the bottom face of the casing.

9. The power supply device according to claim 8, wherein the substrate unit is pressed by a pressing member against the bottom face of the casing along a direction at which the primary print-coil substrate, the secondary print-coil substrate and the main circuit substrate are stacked.

10. The coil unit according to claim 2, wherein the U-shaped terminal is further provided with a resin part having a contact face which covers a part of the conductor on the side opposite to the open end side and which is in contact with the secondary print-coil substrate when the two open ends are inserted through the first connection terminal part and the second connection terminal part.

11. The substrate unit comprising:

the coil unit described in claim 3; and a main circuit substrate which is installed on the lower face side of the primary print-coil substrate of the coil unit; wherein an open end on the side which is not inserted through the first external-use terminal part in the first external-use U-shaped terminal and an open end on the side which is not inserted through the second external-use terminal part in the second external-use U-shaped terminal are inserted through connection through holes installed on the main circuit substrate and electrically connected to the conductor pattern mounted on the main circuit substrate, thereby being connected to the conductor pattern installed on the main circuit substrate.

12. The substrate unit according to claim 11, wherein the open end length of the U-shaped terminal, that of the first external-use U-shaped terminal and that of the second external-use U-shaped terminal is longer than a total sum comprising the thickness of the primary print-coil substrate, the thickness of the secondary print-coil substrate and the thickness of the main circuit substrate, the main circuit substrate is further provided with a cut-off port through which each of the open ends not being inserted through the connection through hole is inserted, among the open ends of the U-shaped terminal, the first external-use U-shaped terminal and the second external-use U-shaped terminal, and a side face of the open end is kept away from an inner face of the cut-off port, when the open end is inserted.

13. A power supply device comprising:

the substrate unit described in claim 11; and a casing which houses the substrate unit; wherein the lower face of the substrate unit is mounted so as to be in contact with the bottom face of the casing.

14. The power supply device according to claim 13, wherein the substrate unit is pressed by a pressing member against the bottom face of the casing along a direction at which the primary print-coil substrate, the secondary print-coil substrate and the main circuit substrate are stacked.

* * * * *